US007124615B1

(12) United States Patent
Gallegos

(10) Patent No.: US 7,124,615 B1
(45) Date of Patent: Oct. 24, 2006

(54) TOOL FOR STRAIGHTENING THE FRAME SURROUNDING A VEHICLE WINDSHIELD, WINDOW OR DOOR OPENING

(76) Inventor: Ramsey J. Gallegos, 5301 Union Mine Rd., El Dorado, CA (US) 95623

( * ) Notice: Subject to any disclaimer, the term of this patent is extended or adjusted under 35 U.S.C. 154(b) by 0 days.

(21) Appl. No.: 11/044,380

(22) Filed: Jan. 27, 2005

(51) Int. Cl.
*B21D 1/12* (2006.01)

(52) U.S. Cl. ..... 72/392; 72/308; 72/705

(58) Field of Classification Search ..... 72/392, 72/463, 705, 308, 395
See application file for complete search history.

(56) References Cited

U.S. PATENT DOCUMENTS 1,397,465 A 11/1921 Steffey
1,686,442 A 10/1928 Do Ran
2,200,133 A 5/1940 Mandl
2,305,995 A 12/1942 Roberts
2,956,458 A 10/1960 Hougen
3,015,353 A 1/1962 Brown
3,891,187 A * 6/1975 Bearden, Jr. ..... 254/93 R
3,981,172 A * 9/1976 Hess et al. ..... 72/370.08
4,238,951 A * 12/1980 Grainger et al. ..... 72/457
4,549,423 A 10/1985 Masui
5,087,019 A 2/1992 Peabody et al.
6,216,524 B1 4/2001 Weschler
6,431,522 B1 8/2002 Cutrell, Sr. et al.

* cited by examiner

*Primary Examiner*—Lowell A. Larson
(74) *Attorney, Agent, or Firm*—Thomas R. Lampe

(57) ABSTRACT

A tool for straightening the frame surrounding a vehicle windshield, window or door opening includes a tool head defining a recess for receiving the pinchweld of the frame and having an outer bearing surface for engaging adjacent frame structure when the recess receives the pinchweld.

11 Claims, 3 Drawing Sheets

TOOL FOR STRAIGHTENING THE FRAME SURROUNDING A VEHICLE WINDSHIELD, WINDOW OR DOOR OPENING

TECHNICAL FIELD

This invention relates to a tool for straightening the frame surrounding a vehicle windshield, window or door, more particularly a frame including a pinchweld and frame structure adjacent to the pinchweld, by applying forces to the frame.

BACKGROUND OF THE INVENTION

It is well known generally to utilize hydraulic or pneumatic cylinders or jacks to straighten parts of an automobile or other vehicle. Such devices have been employed, for example, to straighten window and door frames and other parts of vehicles such as fenders, wheels, and undercarriages.

Examples of these types of devices, considered to be representative of the current state of the prior art, are shown in the following U.S. patents: U.S. Pat. No. 5,087,019, issued Feb. 11, 1992, U.S. Pat. No. 6,431,522, issued Aug. 13, 2002, U.S. Pat. No. 1,686,442, issued Oct. 2, 1928, U.S. Pat. No. 2,305,995, issued Dec. 22, 1942, U.S. Pat. No. 4,549,423, issued Oct. 29, 1985, U.S. Pat. No. 2,956,458, issued Oct. 18, 1960, U.S. Pat. No. 3,015,353, issued Jan. 2, 1962, U.S. Pat. No. 1,397,465, issued Nov. 15, 1921, U.S. Pat. No. 6,216,524, issued Apr. 17, 2001, and U.S. Pat. No. 2,200,133, issued May 7, 1940.

These devices do not incorporate, teach or suggest the unique combination of structural elements disclosed and claimed herein.

DISCLOSURE OF INVENTION

The present invention relates to a tool which is particularly adapted for straightening the frame surrounding a vehicle windshield, window or door opening including a pinchweld and frame structure adjacent to the pinchweld by applying forces to the frame. The tool is utilized with a hydraulic or pneumatic cylinder or jack and is suitably employed to selectively apply either pulling or pushing forces to the frame.

In addition, the invention is characterized by its simplicity and ease of use. In use, the tool is maintained in a stable condition and is prevented from moving out of operative position relative to the frame by a cooperative relationship between the tool and the frame pinchweld. The tool is one of a plurality of tools having different configurations, the tools being utilized alternatively to conform to different vehicle window and door frame shapes.

The tool includes a connector for connecting the tool to a hydraulic or pneumatic cylinder or jack and a tool head attached to the connector.

The tool head defines a recess for receiving the pinchweld of the frame and has an outer bearing surface for engaging adjacent frame structure of the frame when the recess receives the pinchweld. The recess extends inwardly from the outer bearing surface. The outer bearing surface has outer bearing surface portions engageable with the frame structure disposed on opposed sides of the recess.

The tool head comprises a clamp including a pair of relatively movable clamp members and adjustment structure for relatively moving the clamp members toward or away from one another to vary the size of the recess to selectively clamp or unclamp the frame.

Other features, advantages and objects of the present invention will become apparent with reference to the following description and accompanying drawings.

BEST MODE FOR CARRYING OUT THE INVENTION

Figure 5:
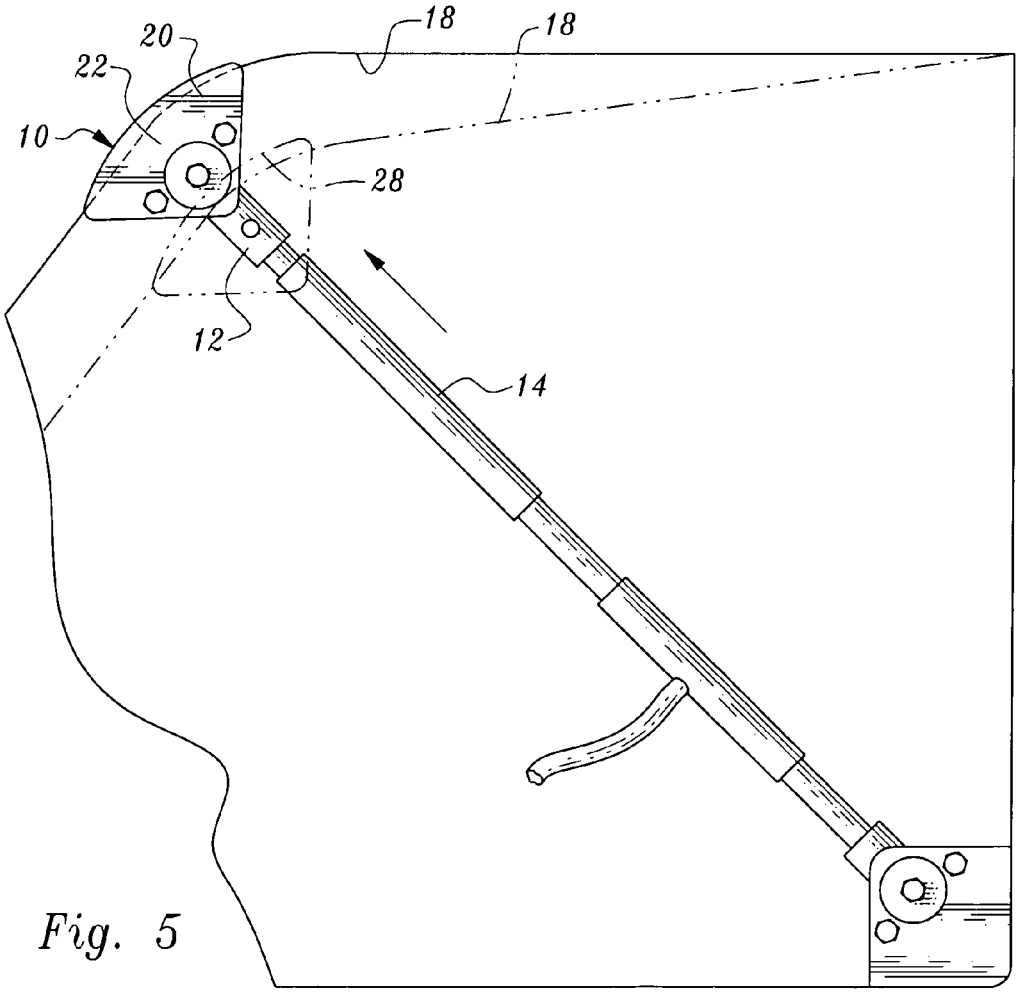
FIG. 5 is a side, elevational view of the tool head of FIG. 2 attached to an end of a hydraulic jack and employed to apply pushing forces on the frame to straighten the frame, alternative positions of the tool head and frame being shown in solid and dash lines.
Figure 10:
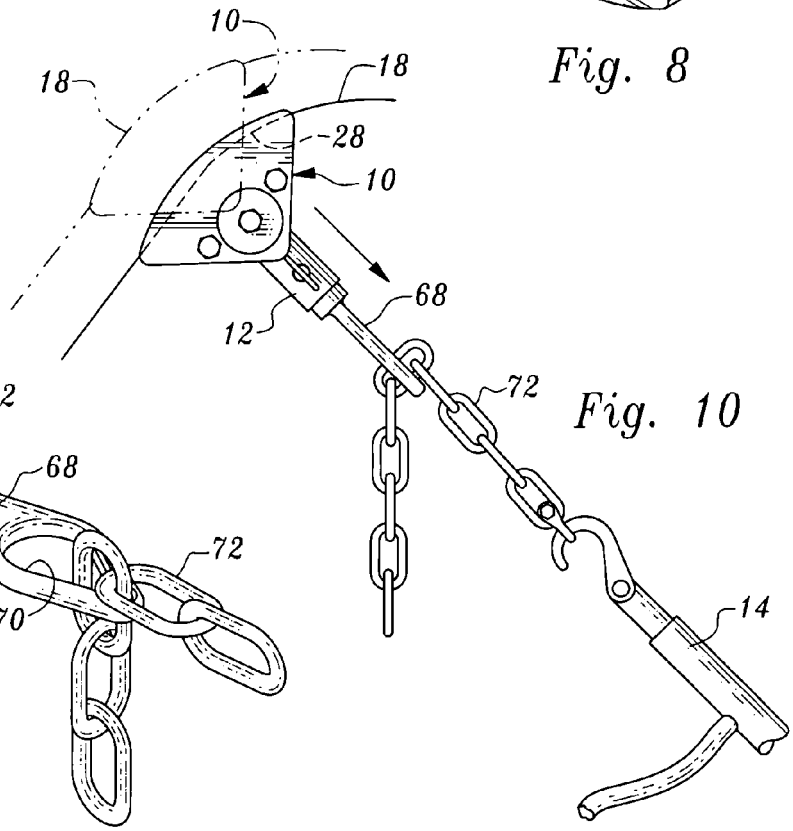
FIG. 10 shows the arrangement of FIGS. 6–9 connected by a chain to an end of a hydraulic cylinder to exert pulling forces on the window frame, the tool head and frame being shown in two alternative positions, one by solid lines and the other by dash lines.

Referring now to the drawings, a tool 10 constructed in accordance with the teachings of the present invention includes a connector 12 for connecting the tool to a hydraulic or pneumatic cylinder or jack, a hydraulic cylinder 14 being illustrated for illustrative purposes. The cylinder 14 may be powered in a conventional manner by a source of hydraulic pressure 16 between extended and retracted conditions. When attached to an end of hydraulic cylinder 14, the tool 10 may be utilized to either apply pushing forces to the frame 18 of a vehicle (as shown in FIG. 5) or pulling forces (as shown in FIG. 10).

Tool 10 also includes a tool head 20 attached to the connector 12. Tool head 20 comprises a clamp including a pair of relatively movable clamp members 22, 24. The clamp members are cooperable to define a recess 26 for receiving the pinchweld 28 of the frame 18. The tool head has an outer bearing surface for engaging the frame structure adjacent to the pinchweld and disposed on either side thereof when the recess 26 receives the pinchweld. That is, the outer end surfaces of the clamp members are essentially identical in configuration and engage the frame structure on opposed sides of the pinchweld.

Figure 2:
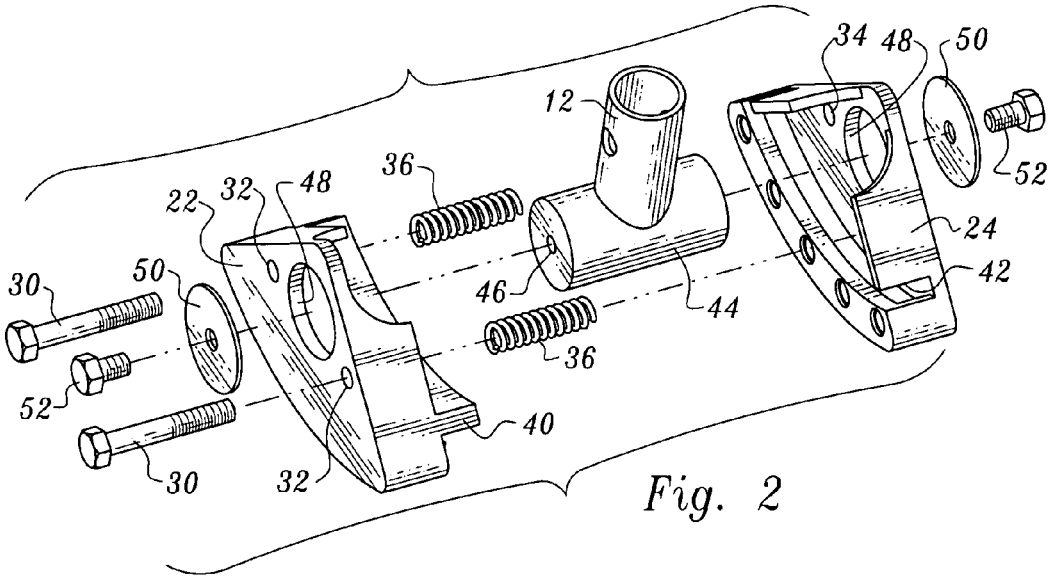
FIG. 2 is an exploded, perspective view of one of the tool heads.
Figure 3:
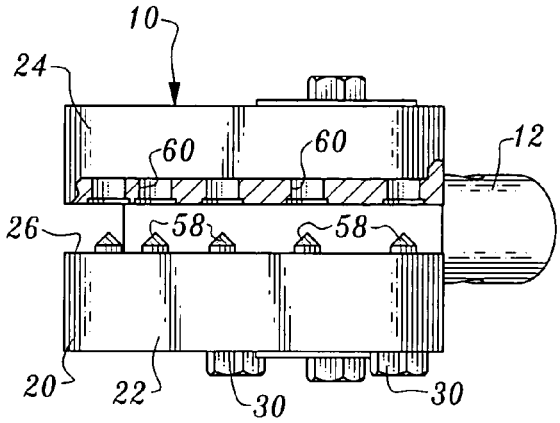
FIG. 3 is an elevational view illustrating clamp members of the tool head of FIG. 2 defining a recess for receiving the pinchweld of a vehicle frame.
Figure 4:
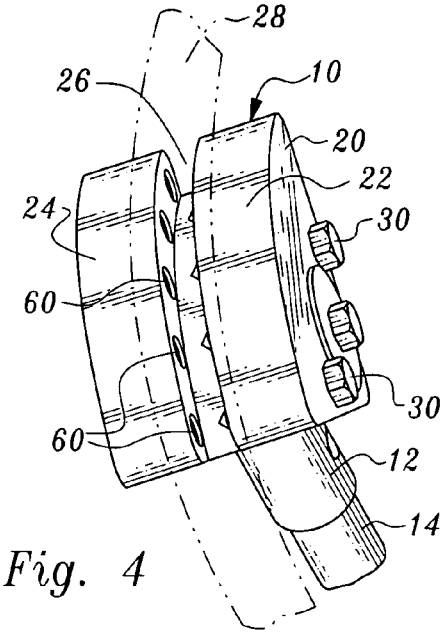
FIG. 4 is a perspective view of the tool head of FIG. 2 in position relative to a vehicle window frame, a portion of the latter being shown in phantom lines.
Figure 6:
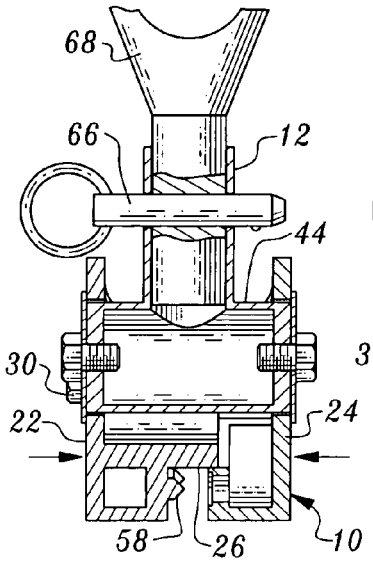
FIG. 6 is a cross-sectional view illustrating details of the tool head of FIG. 2 in unclamped position and attached by a connector to a selectively detachable member defining an opening utilized to apply a pulling force to the tool.
Figure 7:
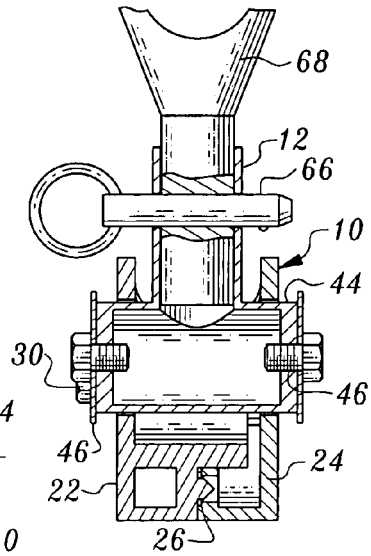
FIG. 7 is a view similar to FIG. 6, but illustrating the clamp members moved toward one another from the position shown in FIG. 6.
Figure 8:
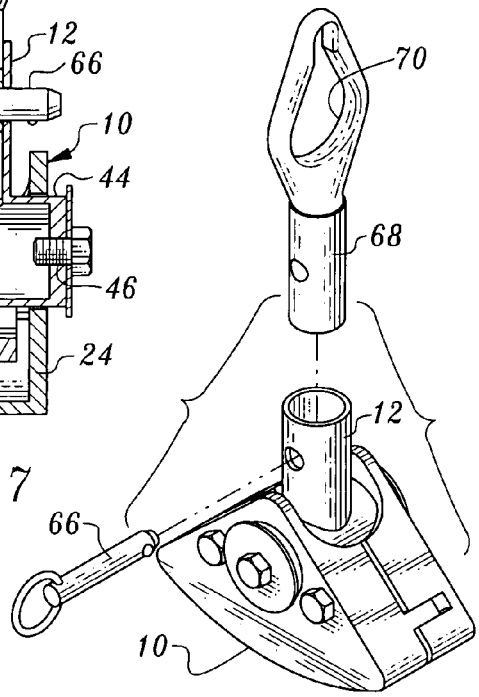
FIG. 8 is an exploded, perspective view of the arrangement shown in FIGS. 6 and 7.
Figure 9:
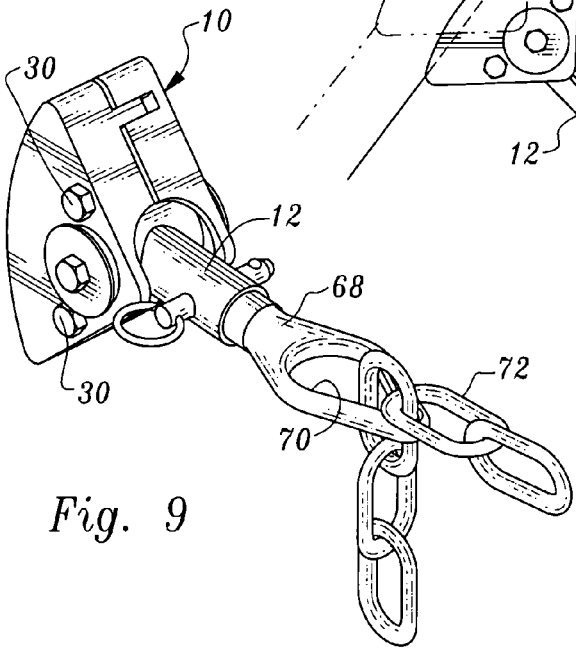
FIG. 9 is a perspective view of the arrangement of FIGS. 6–8 having a chain passed through the opening of the selectively detachable member.

The clamp members 22, 24 are relatively movable toward or away from one another to vary the size of the recess to selectively clamp or unclamp the frame 18. This is accomplished by adjustment structure in the form of two bolts 30 which pass through apertures 32 in clamp member 22 and are threadedly engaged with threaded openings 34 in clamp member 24, one of which is shown in FIG. 2. The bolts 30 pass through compression springs 36 located between the clamp members and which apply opposed compressive forces thereon to continuously urge the clamp members away from one another. Tightening of the bolts 30 will overcome the bias of compression springs 36 and move the clamp members toward one another to narrow the recess 26. FIGS. 3 and 6 show the recess fully opened and FIG. 7 shows the recess essentially closed due to the action of bolt tightening.

Guide member 22 has an arcuate shaped stabilizer projection 40 and clamp member 24 has an arcuate shaped stabilizer opening 42 receiving the projection 40. This structure adds strength and stability to the clamp. The bolts 30 not only cause relative movement of the clamp members 22, 24 toward and away from one another, the bolts serve to lock the clamp members against relative rotational movement so that the clamp members rotate as a unit relative to connector 12 in a manner now to be described.

Connector 12 has a support shaft 44 having threaded apertures 46 at the opposed ends thereof.

The clamp members 22, 24 have round holes 48 formed therein which receive the opposed ends of support shaft 44. Washers 50 are positioned over and cover the holes 48, and bolts 52 pass through the washer openings, holes 48 and into threaded engagement with the threaded apertures 46 of the support shaft. This arrangement enables the joined clamp members 22, 24 to rotate as a unit about support shaft 44 of connector 12.

Projecting from clamp member 22 are teeth 58. These teeth are in alignment with holes 60 formed in clamp member 24. When the clamp members are moved fully toward one another, the teeth enter the holes 60. Thus, the purchase of the clamp on the frame pinchweld is assured and the clamp can be utilized to pull the frame.

One approach to providing this pulling motion is shown in FIGS. 6–10 wherein a lock pin 66 is utilized to releasably secure member 68 defining an opening 70 to the rest of the connector. With this approach a chain 72 attached between the connector and the hydraulic cylinder 14 by a hook employed at the end of the cylinder is employed to exert pulling forces on the tool and frame to which it is clampingly engaged. It will be appreciated that the nesting of the pinchweld in the recess contributes to the maintenance of proper placement and stability of the apparatus during both pulling and pushing operations.

Figure 1:
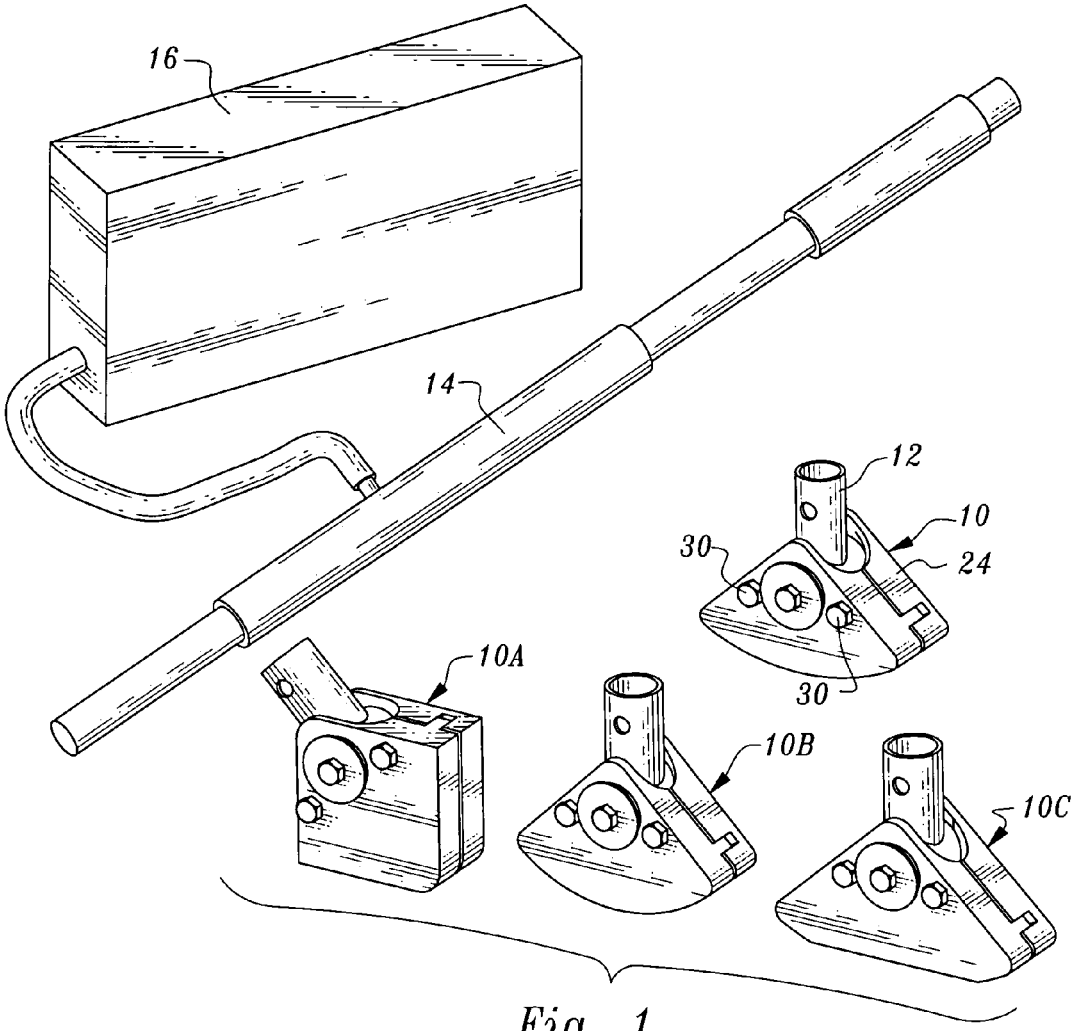
FIG. 1 is a perspective view showing four alternative versions of the tool head which may be utilized with the illustrated hydraulic jack.

Referring now to FIG. 1, tool head 10 is one of a plurality of selectively alternatively employable tool heads. In the illustrated arrangement, tool heads 10A, 10B and 10C are shown, each of which employs relatively movable clamp members defining a recess for receiving a frame pinchweld. The tool heads 10, 10A, 10B and 10C differ in configuration from one another and are selectively alternatively employable to conform to different vehicle windshield, window and door frame shapes.

The invention claimed is:

1. A tool for straightening the frame surrounding a vehicle windshield, window or door opening including a pinchweld and frame structure adjacent to said pinchweld by applying forces to the frame, said tool including, in combination:

a connector for connecting the tool to a hydraulic or pneumatic cylinder or jack; and a tool head attached to said connector defining a recess for receiving the pinchweld of the frame and having an outer bearing surface for engaging the adjacent frame structure of the frame when the recess receives the pinchweld, the recess extending inwardly from said outer bearing surface, and said outer bearing surface having outer bearing surface portions engageable with the frame structure disposed on opposed sides of said recess, said tool head comprising a clamp including a pair of relatively movable clamp members and adjustment structure for relatively moving said clamp members toward or away from one another to vary the size of said recess to selectively clamp or unclamp said frame.

2. The tool according to claim 1 wherein said tool head is one of a plurality of selectively alternatively employable tool heads, each tool head defining a recess for receiving the pinchweld but differing in configuration from the other of said selectively alternatively employable tool heads to conform to different vehicle window and door frame shapes.

3. The tool according to claim 1 wherein said recess is a slot extending the length of said outer bearing surface.

4. The tool according to claim 1 wherein said tool head is pivotally attached to said connector.

5. The tool according to claim 1 wherein said clamp members are pivotally attached to said connector, said clamp additionally including locking structure locking said clamp members against rotatable movement relative to one another whereby said clamp members are rotatable as a unit relative to said connector.

6. The tool according to claim 5 wherein said locking structure includes a bolt passing through an aperture formed in at least one of said clamp members.

7. The tool according to claim 1 wherein said connector includes a support shaft, at least one of said clamp embers slidable along said support shaft when said adjustment structure causes relative movement between said clamp members.

8. The tool according to claim 7 additionally including biasing structure continuously exerting opposed compressive forces on said clamp members urging the clamp members away from one another.

9. The tool according to claim 7 wherein one of said clamp members has a stabilizer projection and the other of said clamp members defines a stabilizer opening receiving said stabilizer projection to stabilize said clamp members.

10. The tool according to claim 1 wherein said tool head additionally includes teeth projecting from at least one of said clamp members for biting engagement with said frame whereby said tool can exert pulling forces on said frame.

11. The tool according to claim 10 wherein said connector includes a selectively detachable member defining an opening for receiving structure associated with a hydraulic or pneumatic cylinder or jack to apply a pulling force to said tool and frame.

* * * * *